United States Patent [19]

Kurick

[11] 4,287,990

[45] Sep. 8, 1981

[54] GLASS SHEET SHIPPING PACKAGES

[75] Inventor: James F. Kurick, Perrysburg, Ohio

[73] Assignee: Libbey-Owens-Ford Company, Toledo, Ohio

[21] Appl. No.: 61,754

[22] Filed: Jul. 30, 1979

[51] Int. Cl.[3] ..... B65D 85/48

[52] U.S. Cl. ..... 206/448; 206/454; 206/597; 206/523; 220/4 B

[58] Field of Search ..... 206/448, 454, 523, 593, 206/597; 220/4 B, 8

[56] References Cited

U.S. PATENT DOCUMENTS

| | | | |
|---|---|---|---|
| 2,665,804 | 1/1954 | Koester | 206/448 |
| 2,734,626 | 2/1956 | Koester et al. | 206/448 |
| 2,781,902 | 2/1957 | Smithers | 206/523 |
| 2,806,592 | 9/1957 | Hatfield | 206/448 |
| 2,938,564 | 3/1960 | Guinane | 206/454 |
| 3,166,188 | 1/1965 | Koester | 206/448 |
| 3,243,037 | 3/1966 | Luertzing | 206/523 |
| 3,389,789 | 6/1968 | Lidgard | 206/448 |
| 3,511,990 | 5/1970 | Hauss | 206/454 |
| 3,589,507 | 6/1971 | Greenberg et al. | 206/454 |
| 3,990,576 | 11/1976 | Heaney | 206/454 |

FOREIGN PATENT DOCUMENTS

| | | | |
|---|---|---|---|
| 649626 | 3/1976 | U.S.S.R. | 206/454 |

*Primary Examiner*—Joseph Man-Fu Moy

*Attorney, Agent, or Firm*—Collins, Oberlin & Darr

[57] ABSTRACT

A composite package for shipping and storing a stack of individual sheets of glass or the like and particularly curved automotive glass articles. The package includes a rigid outer male member and a removable female closure member, each fabricated from a resilient, shock-absorbing material. The sheets of glass are supported on edge by a pair of spaced apart rigid members projecting from the male member into the female closure member and are immobilized therewithin by resiliently contacting pairs of inner braces integrally formed on each of the members. The glass sheets are secured within the package by banding straps threaded through the male and female members and around the glass sheets. The male and female closure members are provided with mating and interfitting joining devices and may be secured together with bandings such as, for example, heat-shrinkable strech wraps, banding straps or the like. The shipping packages are stackable when assembled.

10 Claims, 6 Drawing Figures

GLASS SHEET SHIPPING PACKAGES

BACKGROUND OF THE INVENTION

1. Field of the Invention

The present invention relates broadly to the transporting of sheet materials, and more particularly to an improved package for shipping and storing a stack of individual automotive windshields or other curved glass articles.

2. Description of the Prior Art

Heretofore, many different types of shipping containers have been employed to transport and store a plurality of curved glass articles on edge, including corrugated fiber board containers, wire bound wooden cases and the like. The performance and serviceability of these containers, of course, depends upon the quality of the materials used, the skill of the workers in assembling and loading the containers, etc. In the past, these shipping containers were provided with many, and sometimes complex, components to prevent shifting of the stack of glass articles which could result in marring and breakage of the individual glass articles. Thus, it is desirable to provide a shipping container that is quickly and easily assembled and within which the glass articles are tightly held, thus preventing any damage thereto.

SUMMARY OF THE INVENTION

Generally speaking, the shipping package of this invention comprises a unitized package including a two-section container, a pair of banding straps threaded through the container sections around glass articles contained therein, and means for securing the container sections together. The banding straps bring sufficient pressure to bear on the edges of the glass articles in a direction parallel to the faces of the articles for preventing movement of the articles in their planes and also in directions transverse to the planes.

More specifically, the two-section container comprises a male supporting member and a female closure member fabricated from a resilient shock-absorbing material, the container being adapted to receive and tightly hold a stack of curved automotive windshields or the like. The male member is provided with a pair of spaced apart supporting members and the female closure member is provided with a pair of matching apertures adapted to receive the supporting members. Banding straps are threaded through the apertures over the supporting members to securely hold the stack of windshields to the male and female members. The male and female members are provided with mating and interfitting connectors and may be further held together by banding with a heat-shrinkable stretch wrap or other type of banding.

OBJECTS AND ADVANTAGES

It is therefore an object of this invention to provide a shock-absorbing shipping package which is lightweight yet safely contains a number of curved glass articles during the transportation and storage thereof.

Another object is to provide a shipping package which is resilient yet firmly supports and holds articles therewithin by banding the articles thereto so as to prevent movement and resulting damage or breakage thereof.

Yet another object is to provide a shipping package that is simple in construction, easy to load and assemble, and accommodates a stack of articles having curved facial and peripheral configurations.

Other objects and advantages of the invention will become more apparent during the course of the following description when taken in connection with the accompanying drawings.

BRIEF DESCRIPTION OF THE DRAWINGS

In the drawings, wherein like numerals are employed to designate like parts throughout the same.

DESCRIPTION OF THE PREFERRED EMBODIMENTS

Figure 1:
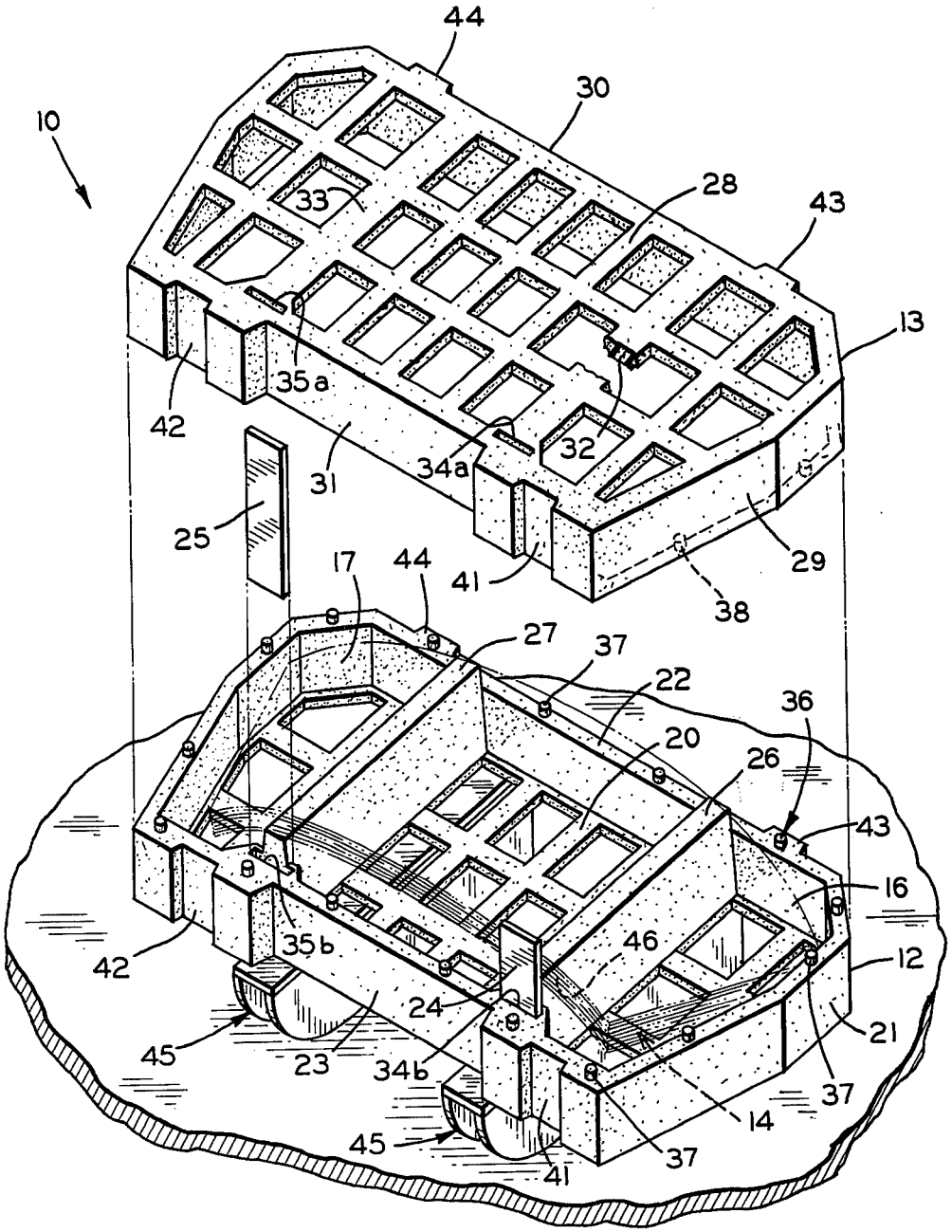
FIG. 1 is an exploded perspective view of a shipping container constructed in accordance with the invention, the male member of the container being shown positioned on a rocker-type dolly for receiving curved glass windshields.

Although not restricted thereto, the shipping package constructed in accordance with the invention and designated in its entirety by the numeral 10, is particularly adapted to the transportation of curved glass sheets such as windshields or rear windows of automobiles or trucks. Automobile windshields are generally curved throughout their length while truck windshields are more flat in the central region with sharper curves at the ends. To accommodate these various windshield configurations, the shipping package includes a two-section container, designated in its entirety by the numeral 11, having bottom supporting and side bracing members which include flat surfaces angularly disposed relative to one another. The container 11 is a rigid box-like structure comprising a male member 12 and a female closure member 13, each member 12 and 13 being fabricated from a rigid, resilient shock-absorbing material, for example a material such as polystyrene. By the use of such a material, a high level of protection is provided for a stack 14 of curved glass articles 15 contained therein. In addition to having angularly disposed bottom supporting and side bracing surfaces, the container 11 is provided with end cavities 16 and 17 for accommodating the curved portions of the stack of glass articles. The stack 14 of glass articles 15 is secured within the container 11 by a pair of banding straps 18 and 19, threaded through the members 12 and 13 and around the stack of glass articles, and which apply pressure to the stack of glass articles in both the horizontal and vertical directions.

Figure 4:
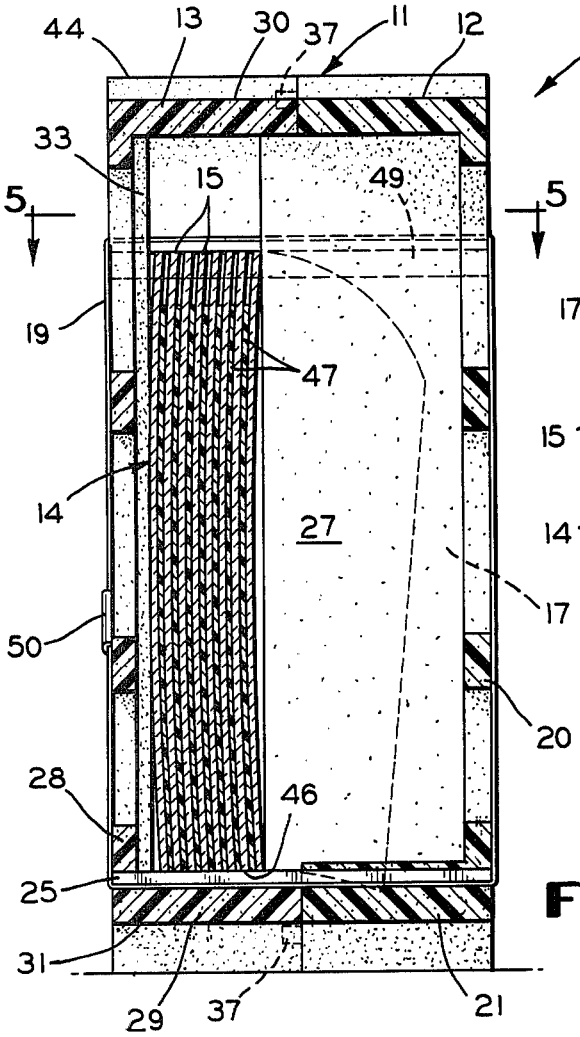
FIG. 4 is a cross sectional view taken substantially along line 4—4 of FIG. 3.
Figure 5:
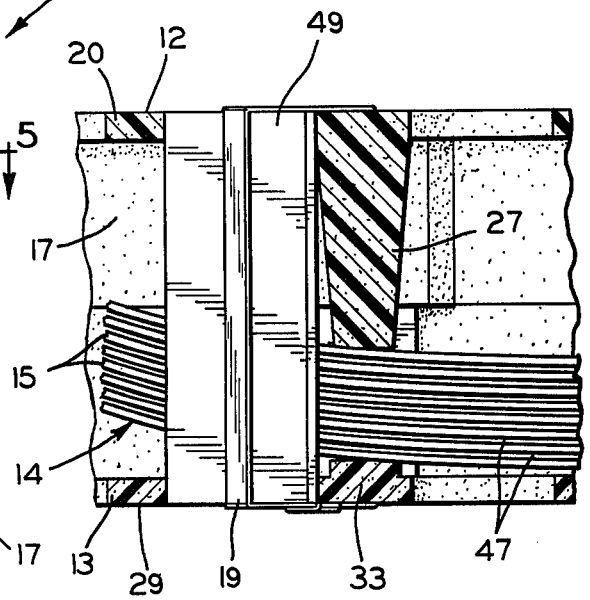
FIG. 5 is an enlarged fragmentary view, partly in section, and taken substantially along line 5—5 of FIG. 4.

Referring now to the drawings and particularly to FIGS. 1 and 4, the container 11 is elongate and of generally rectangular configuration and comprises the male member 12 and the female closure member 13 which are similar in size and shape. More specifically, the male member 12 includes a lattice side wall 20 having a peripheral wall 21 extending perpendicularly therefrom. As best illustrated in FIG. 4, the peripheral wall 21 includes top and bottom portions 22 and 23, respectively. Projecting above the outer surface of the peripheral wall 21 adjacent the bottom portion 23, is a pair of spaced apart bottom supporting members 24 and 25. Extending between and above the outer surfaces of the top and bottom portions 22 and 23, respectively, is a pair of back brace members 26 and 27. The end cavities 16 and 17 are provided outwardly of the brace members 26 and 27.

The female closure member 13 also includes a lattice side 28 having a peripheral wall 29 extending perpendicularly therefrom and having a configuration similar to the peripheral wall 21 of the male member 12. The peripheral wall 29 includes top and bottom portions 30 and 31, respectively. Extending between these top and bottom portions are thickened rib portions 32 and 33 which serve as front bracing members for the stack of glass articles. Adjacent the bottom portion 31 of the peripheral wall 29, a pair of elongated apertures 34 and 35 (see FIG. 2) is provided for receiving the ends of the supporting members 24 and 25 projecting from the male member 12.

Figure 6:
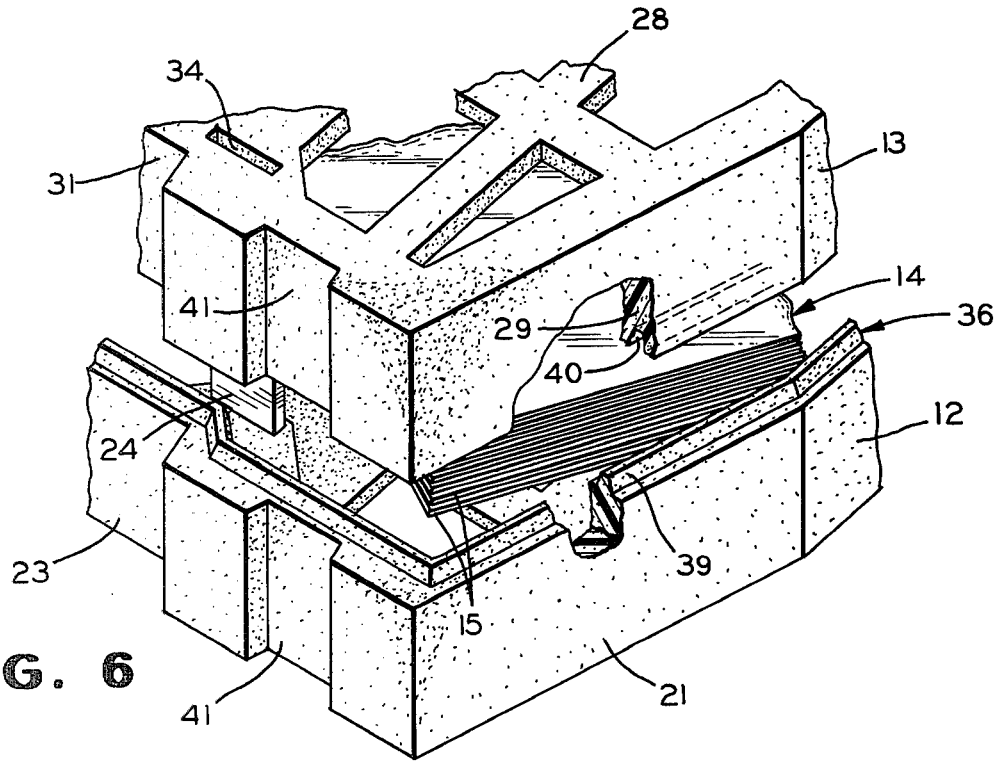
FIG. 6 is an enlarged fragmentary perspective view of the container showing a modified version of the mating surfaces between the two container sections.

The adjoining surfaces of the peripheral walls 21 and 29 of the male member 12 and the female member 13, respectively, are provided with interfitting and mating connector portions 36 spaced entirely around their periphery. More specifically, as illustrated in FIG. 1, the connector portions 36 comprise pins 37 projecting from the wall 21 of the male member 12 and sockets 38 provided in the wall 29 of the female member 13. On the other hand, as illustrated in FIG. 6, the adjoining surfaces of the male and female members 12 and 13 may be provided with interfitting and mating tongue and groove connector portions 39 and 40, respectively.

The outer surfaces of the bottom wall portions 23 and 31 of the male and female members 12 and 13, respectively, are each provided with a pair of spaced apart transverse grooves 41 and 42 and the outer surface of the top wall portions 22 and 30 of the male and female members 12 and 13, respectively, are each provided with a pair of tongues 43 and 44 interfitting with the grooves 41 and 42, respectively, thus providing for nesting of the shipping packages 10 when stacked one upon another.

Within the above-described structure, a stack 14 of the bent glass articles 15, such as automotive windshields, is suitably contained for shipment or storage. As viewed in FIG. 1, the male member 12 of the container 11 is placed on a rocker-type dolly 45, and a stack of bent glass articles 15 is placed on the side bracing members 26 and 27 with its bottom edge 46 resting against the pair of bottom support members 24 and 25. The support members 24 and 25 are received in apertures **34*a* and 35*a* provided in the male member 12 (see FIG. 1) and are of such length as to extend into the apertures 34*b* and 35*b* provided in the female closure member 13 (see FIG. 1). A desired number of glass articles 15, separated from each other by foam cushioning sheets 47, are placed on the male member 12. The female closure member 13 is then placed over the stack 14 of glass articles 15 with the thickened rib portions 32 and 33 thereof resting against the outer face of the top glass article 15. A pair of rigid pressure members 48 and 49, of suitable length, is placed on the top edges of the glass articles 15, through suitable openings of the lattice sides 20 and 28 of the members 12 and 13, respectively. The banding straps 18 and 19 are then threaded through the apertures 34 and 35 and clamped as at 50 to secure the stack 14 of glass articles to the container members 12 and 13** and the container members together.

Figure 2:
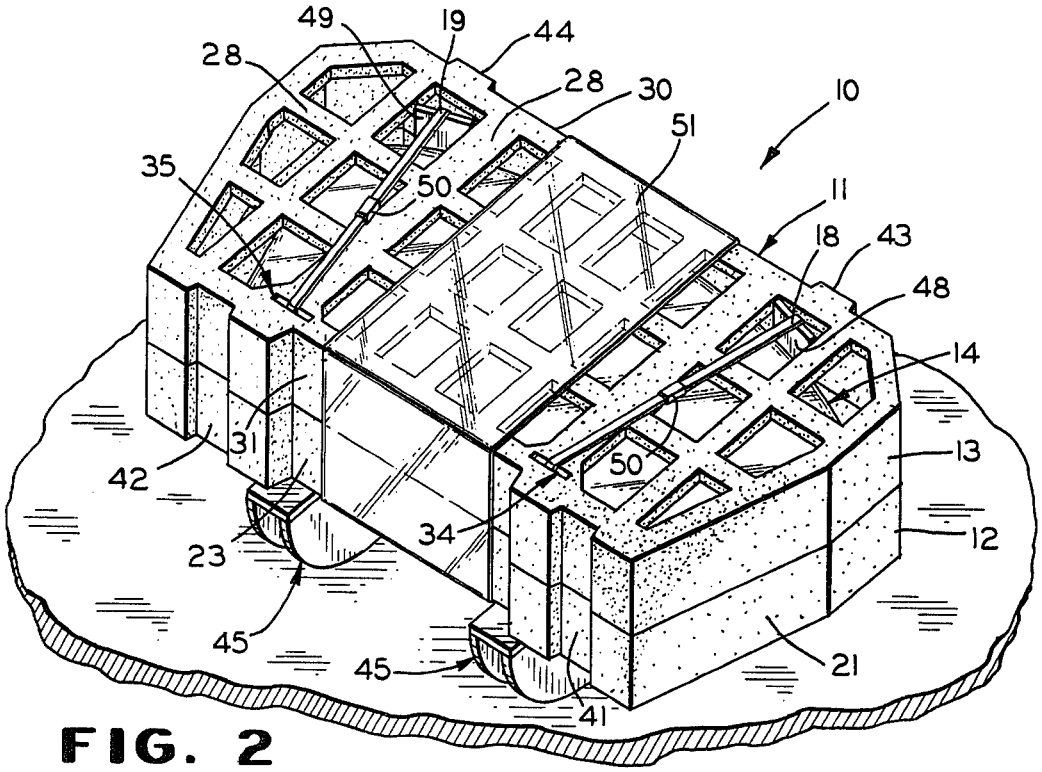
FIG. 2 is a perspective view similar to FIG. 1 but showing the components of the shipping container assembled.
Figure 3:
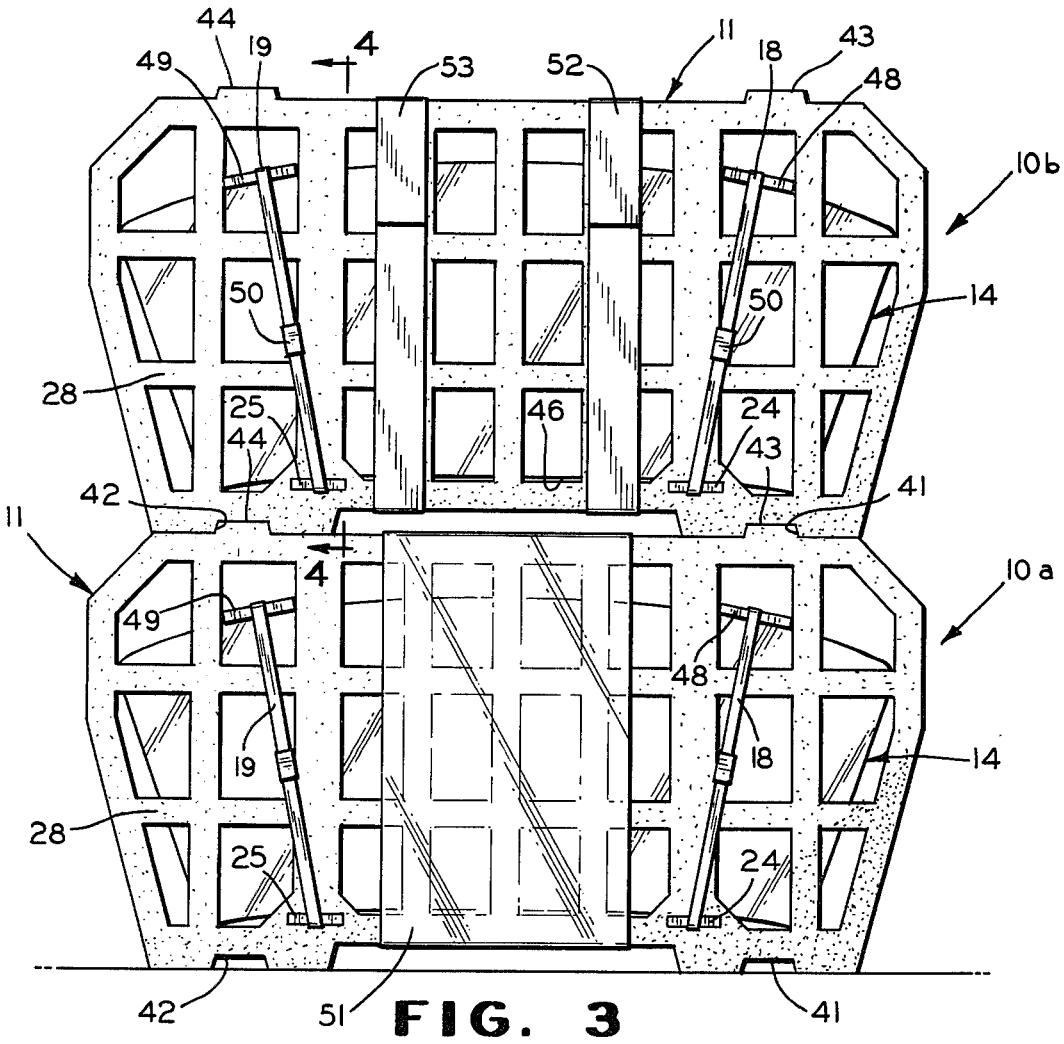
FIG. 3 is an elevational view of a pair of the shipping containers illustrated in FIG. 1 showing them stacked two high sitting on a floor in their normal transporting and storing positions.

Referring now to FIG. 2, the male member 12 may be further secured to the female closure member 13 by means such as a heat-shrinkable plastic sheet 51 shrunk tightly around and partially enclosing the central region of the container members 12 and 13. The shipping package 10 is then placed in its designed upright transporting position, as illustrated by the lowermost shipping package **10*a* of FIG. 3. On the other hand, the members 12 and 13 may be secured together by a pair of spaced apart adhesive banding tapes 52 and 53 which surround the central region of the container sections 12 and 13 as illustrated on the uppermost shipping package 10*b* of FIG. 3**, or for that matter with steel banding straps and corner protectors (not shown).

After the shipping package 10 is loaded with a stack of glass sheets and the stack of sheets is secured in the manner outlined above, the assembled shipping package can then be stood upright and moved, for example by a forklift truck, into a truck or railroad car for transportation or to an area of storage. In either event the shipping packages, due to the nature of the material from which they are fabricated, are preferably only stacked one on another, that is, two high.

It is to be understood that the forms of the invention herewith shown and described are to be taken as preferred embodiments only of the same and that various changes in the shape, size and arrangement of the parts may be resorted to without departing from the spirit of the invention.

I claim:

1. In a composite shipping package of the type containing a stack of upstanding sheets of glass having curved end portions, wherein said sheets are supported on edge, the improvement comprising:

(a) an elongate, integrally formed, substantially rectangular male member, with spaced apart support members extending into and projecting from said male member for supporting said stack of glass sheets on edge, said male member being provided with a pair of spaced apart recesses for receiving the curved end portions of said stack of glass sheets and including a pair of side supporting members extending transversely thereacross and above the surfaces of the walls defining said recesses, said side supporting members bearing against one of the major surfaces of the stack of glass sheets;

(b) an elongate, integrally formed, substantially rectangular female closure member matching and interfitting with said male member and having a cavity for receiving said stack of glass sheets, said female closure member having apertures for receiving said support members projecting from said male member;

(c) means for securing said stack of glass sheets within said male and said female closure members; and (d) further means surrounding said female closure member and said male member for securing them together.

2. A composite shipping package containing a stack of glass sheets as claimed in claim 1, wherein said female closure member includes a pair of transversely extending rib members bearing against the opposite major surface of said stack of glass sheets.

3. A composite shipping package containing a stack of glass sheets as claimed in claim 2, wherein said male member and said female closure member are each integrally formed in one piece of polystyrene material.

4. A composite shipping package containing a stack of glass sheets as claimed in claim 1, wherein said means for securing said stack of glass sheets within said male member and said female closure member is a pair of banding straps threaded through said members and around said stack of glass sheets.

5. A composite shipping package containing a stack of glass sheets as claimed in claim 4, including rigid support members disposed between said banding straps and the top and bottom edges of said stack of glass sheets.

6. A composite shipping package containing a stack of glass sheets as claimed in claim 1, wherein said further means for securing said female closure member to said male member comprises a heat-shrinkable stretch wrap encasing the central region of said members.

7. A composite shipping package containing a stack of glass sheets as claimed in claim 1, wherein said further means for securing said female closure member to said male member comprises a pair of spaced-apart, adhesive banding straps surrounding the central regions of said members.

8. A composite shipping package containing a stack of glass sheets as claimed in claim 1, including interlocking means for connecting the adjoining surfaces of said male member and said female closure member.

9. A composite shipping package containing a stack of glass sheets as claimed in claim 8, wherein said interlocking means comprises a plurality of cooperating pin and socket devices spaced around the periphery of the adjoining surfaces of said male member and said female closure member.

10. A composite shipping package containing a stack of glass sheets as claimed in claim 8, wherein said interlocking means comprises mating and interfitting tongues and grooves extending around the periphery of the adjoining surfaces of said male member and said female closure member.

* * * * *